US007007878B2

(12) United States Patent
Strong

(10) Patent No.: US 7,007,878 B2
(45) Date of Patent: Mar. 7, 2006

(54) WASTE PRODUCT RIPPING AND GRINDING MACHINE AND METHODS OF CONSTRUCTING AND OPERATING THE MACHINE

(75) Inventor: James L. Strong, Remus, MI (US)

(73) Assignee: Morbark, Inc., Winn, MI (US)

( * ) Notice: Subject to any disclaimer, the term of this patent is extended or adjusted under 35 U.S.C. 154(b) by 0 days.

(21) Appl. No.: 10/775,257

(22) Filed: Feb. 10, 2004

(65) Prior Publication Data

US 2004/0159729 A1 Aug. 19, 2004

Related U.S. Application Data

(60) Provisional application No. 60/446,306, filed on Feb. 10, 2003.

(51) Int. Cl.
*B02C 18/16* (2006.01)

(52) U.S. Cl. ..... 241/236; 241/295

(58) Field of Classification Search ..... 241/294, 241/295, 101.74, 101.741, 236, 243
See application file for complete search history.

(56) References Cited

U.S. PATENT DOCUMENTS 1,435,330 A 11/1922 Pardee
4,205,799 A 6/1980 Brewer
5,269,355 A * 12/1993 Bowen ..... 144/223
6,092,751 A 7/2000 Kottmann

FOREIGN PATENT DOCUMENTS

| | | | |
|---|---|---|---|
| DE | 2838001 | A1 | 4/1980 |
| DE | 8708702 | U1 | 12/1987 |
| DE | 9415955 | U1 | 1/1995 |
| DE | 29708406 | U1 | 9/1997 |
| DE | 10011302 | A1 | 9/2001 |
| DE | 10015220 | A1 | 10/2001 |
| EP | 0529221 | B1 | 3/1993 |
| EP | 0876843 | A1 | 11/1998 |

* cited by examiner

*Primary Examiner*—Mark Rosenbaum
(74) *Attorney, Agent, or Firm*—Reising, Ethington, Barnes, Kisselle & Learman, P.C.

(57) ABSTRACT

A vehicle has a housing mounting within it a rotor assembly comprising parallel shafts having intermeshing cutter discs in axially spaced relation thereon. The discs have radial projections with first cutting edges extending axially to face in a rotatively leading direction. Cutter segments carried on the discs project radially outwardly to provide second cutting edges of lesser axial extent facing in the leading direction. A toothed member mechanism carries teeth which project into the axial spaces between the discs and provides axial surfaces for coacting with the first and second cutting edge.

18 Claims, 9 Drawing Sheets

WASTE PRODUCT RIPPING AND GRINDING MACHINE AND METHODS OF CONSTRUCTING AND OPERATING THE MACHINE

FIELD OF THE INVENTION

This invention claims the priority of provisional application Ser. No. 60/446,306, filed on Feb. 10, 2003, and relates to machines for comminuting primarily waste wood products, but also other refuse and disintagratable material.

BACKGROUND OF THE INVENTION

Rotor assemblies for relatively high speed heavy machinery such as hammer mills and wood hogs for fragmenting waste wood such as demolition debris, stumps, pallets, large timbers, and the like into particulate or chips, which are useful, are known. The present assignee owns U.S. Pat. No. 5,713,525 issued Feb. 3, 1998 for a typical wood hog machine and U.S. Pat. No. 5,419,502 issued May 30, 1995 for a typical tub grinder hammer mill system. Machines of this character are well classified as heavy machinery which require considerable driving power. Such machinery includes typically a multiplicity of hammers with hammer heads, mounting hammer knives on their rotatable outer ends.

SUMMARY OF THE INVENTION

A slower speed rotor and cooperating element assembly for much of the same waste wood which is fragmented by the heavier machinery mentioned, and is also adaptable for handling smaller size waste material such as brush and the like, includes a pair of counter rotating shafts driving a series of axially spaced intermeshing rotary blades, which also mesh with comb teeth provided on side comb systems and an underneath breaker bar system.

While the invention has a number of objects, one of the prime objects of the invention is to provide a relatively slower speed, increased torque machine, operable at speeds less than, for example, 40 rpm, which is relatively inexpensive to manufacture and will operate for a prolonged time in heavy work conditions.

Another object of the invention is to provide a machine of the character described which has knife edges supported to withstand considerable compressive impact forces and resist fracture.

Other objects and advantages of the invention will become apparent with reference to the accompanying drawings and the accompanying descriptive matter.

BRIEF DESCRIPTION OF THE DRAWINGS

A presently preferred embodiment of the invention is disclosed in the following description and in the accompanying drawings, wherein.

DESCRIPTION OF THE PREFERRED EMBODIMENT

Figure 1:
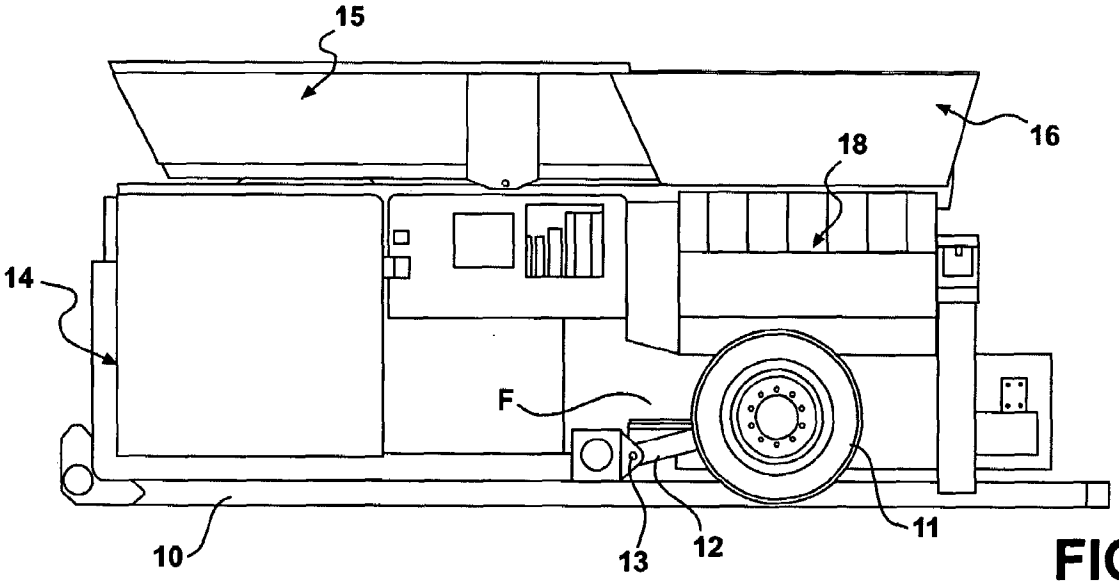
FIG. 1 is a schematic side elevational view of the machine.
Figure 2:
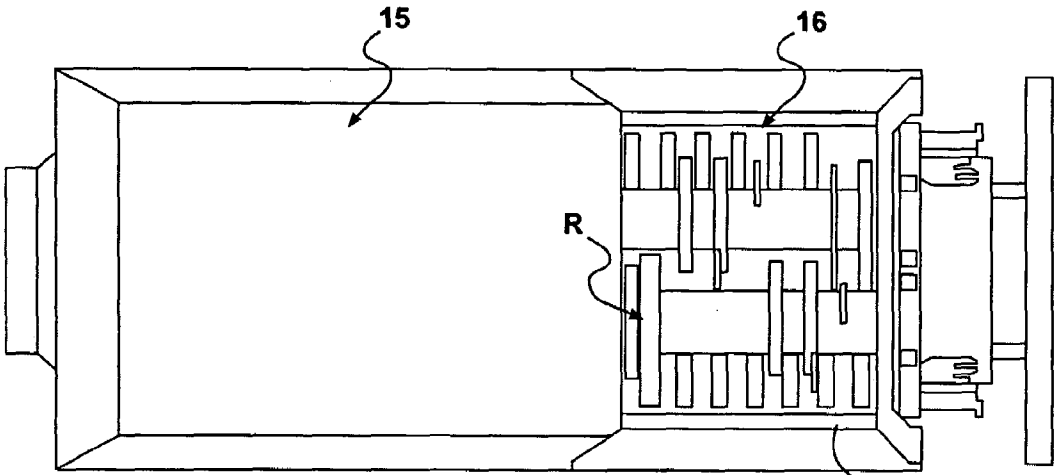
FIG. 2 is a fragmentary top plan view thereof.

Referring now more particularly to FIGS. 1 and 2 in the first instance, wherein the entire machine is schematically depicted. The letter F, generally depicts the frame of the machine, which includes a supporting frame system including longitudinally extending lower beams 10 and a wheel 11 mounted on each side of the frame F on an arm assembly 12, which can be power swung downwardly about a pivot 13 to support the machine for trailered or other travel from its front end 14.

Figure 3:
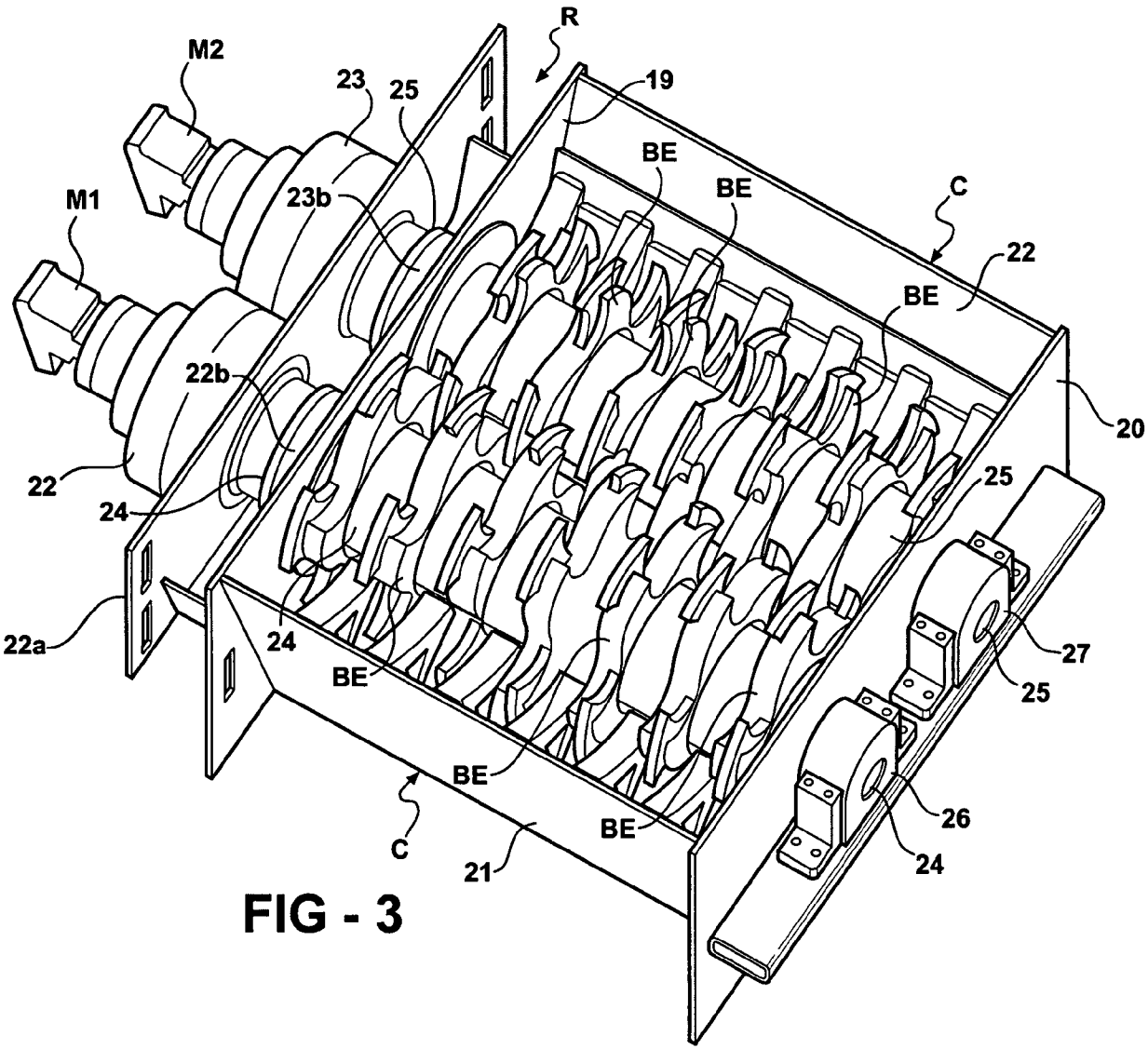
FIG. 3 is a top plan perspective view illustrating the twin shaft rotor assembly only.

The frame F of the machine at its upper end supports a bin, generally designated 15, mounted for power operated upward swinging dumping movement about pivots having an axis AX into a fixed hopper, generally designated 16, having enclosing walls 17. Hopper 17 can be otherwise fed with the material to be comminuted, such as by a loader carried by the machine. Housed within the frame F at 18 below the open bottom hopper 16 is the dual rotor assembly, generally designated R, which is illustrated in FIG. 3. The twin rotor assembly R cooperates with side comb assemblies, generally designated C, which are stationarily supported by the frame F and a breaker bar assembly, generally designated B, also stationarily supported by the frame and shown in FIG. 4.

Returning now to FIG. 3, it will be seen that the support housing for the rotor assembly R includes front and rear plates 19 and 20 and side plates 21 and 22, all stationarily supported by the frame F. A pair of reversible hydraulic motors M1 and M2, connected with gear boxes 22 and 23 bolted to frame support wall 22*a*, use oil supplied from a suitable reservoir system to normally drive the motors M1 and M2 in counter rotation. Gear boxes 22 and 23 have output shafts coupled as at 22*b* and 23*b* to drive shafts 24 and 25, which extend through the walls 19 and 20 and are journaled at their opposite ends in bearings 26 and 27. Front end bearings may be provided on the plates 19.

Each of the plates 21 and 22 support identical side comb assemblies of the character generally disclosed in FIGS. 5–8, which incorporate a series of generally triangularly-shaped comb teeth 29 (see FIG. 7) in axially spaced relationship, the teeth having centrally disposed flat tops 30. Separating the teeth are the mound portions 31 having the centrally disposed flat surfaces 32. It is to be understood that the comb members C are identical and both combs are stationarily supported at the sides of the rotor assembly R to cooperate therewith.

Figure 4:
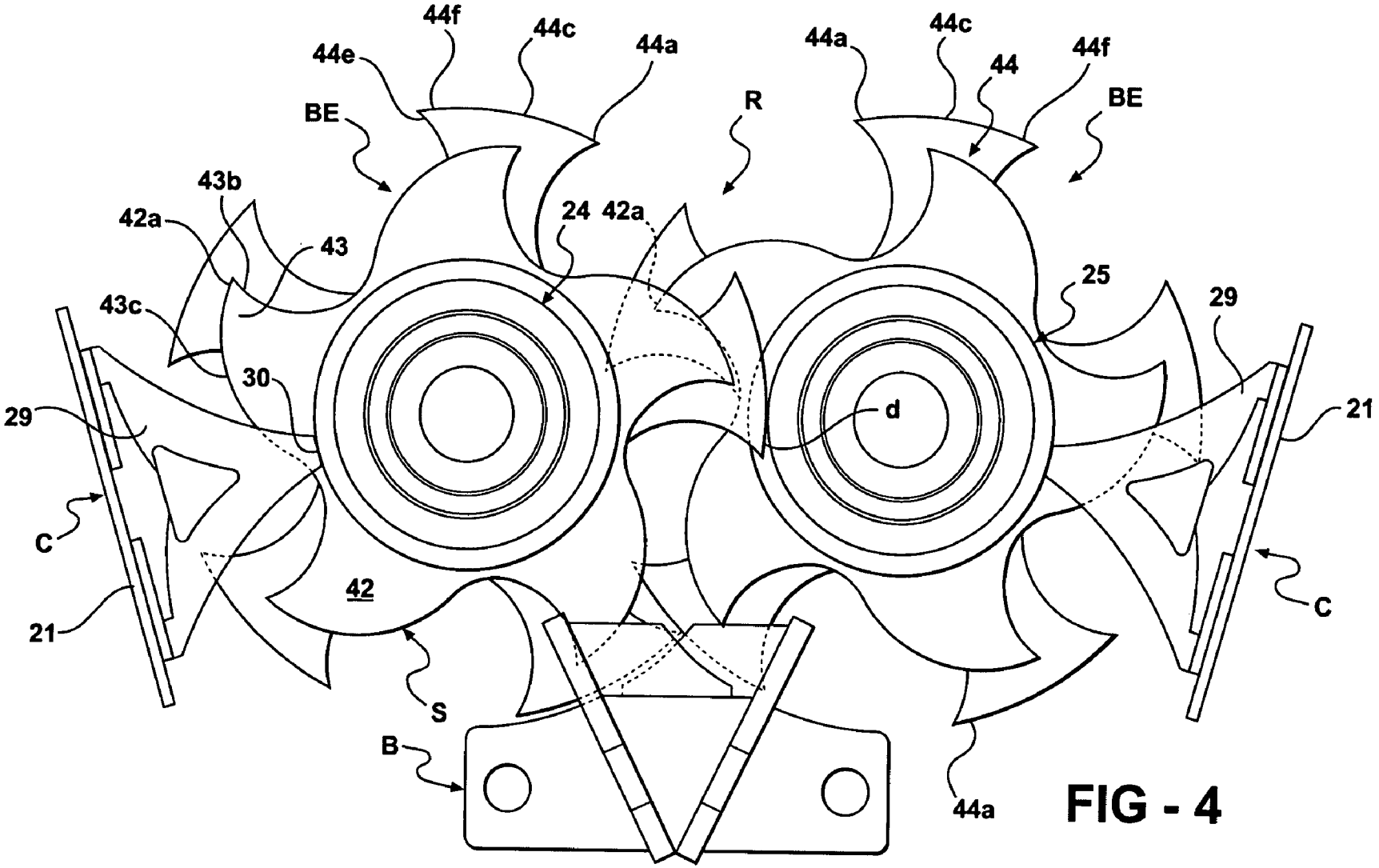
FIG. 4 is an end elevational view of the rotor assembly including the side comb members and the underneath breaker bar assembly illustrating anvil surfaces on the breaker bar assembly and the comb assemblies which coact with the blades of the rotor assembly.
Figure 5:
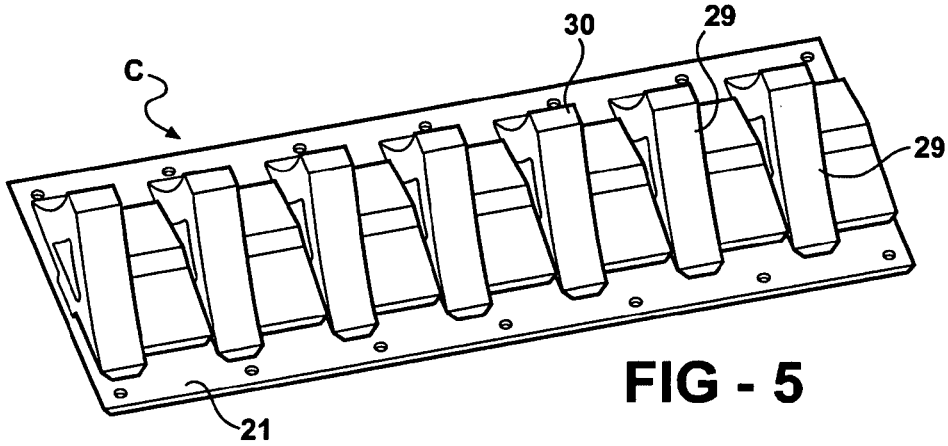
FIG. 5 is an enlarged perspective plan view of one of the side comb members only.
Figure 6:
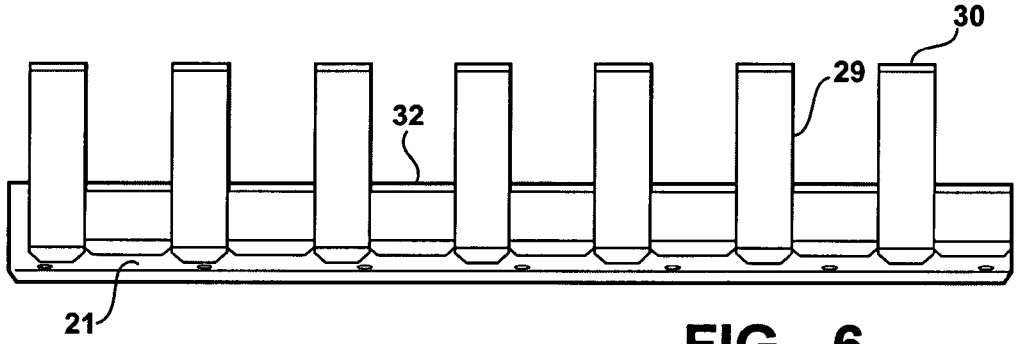
FIG. 6 is a side elevational view thereof.
Figure 7:
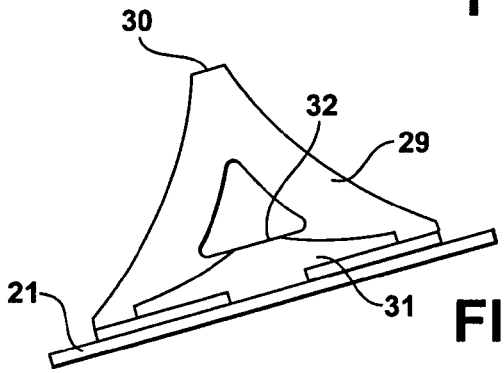
FIG. 7 is an end elevational view thereof.
Figure 8:
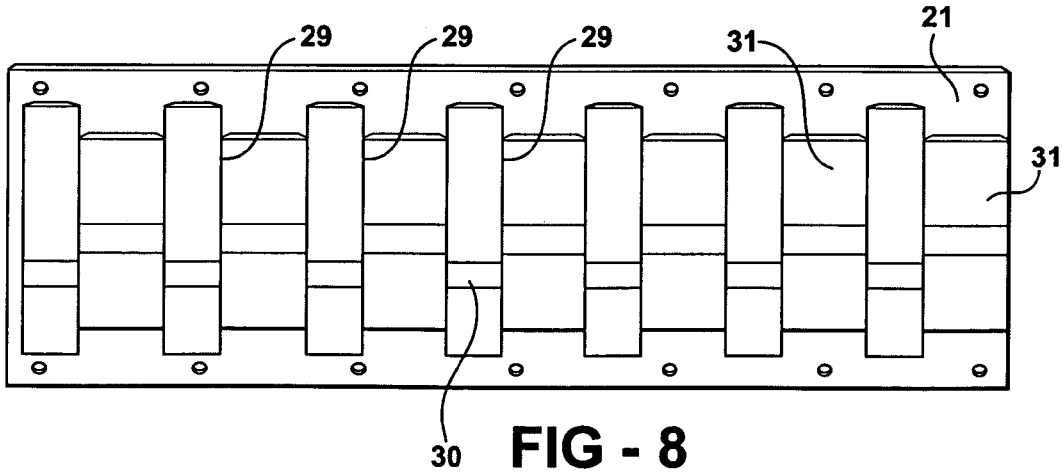
FIG. 8 is a top plan view thereof.
Figure 10:
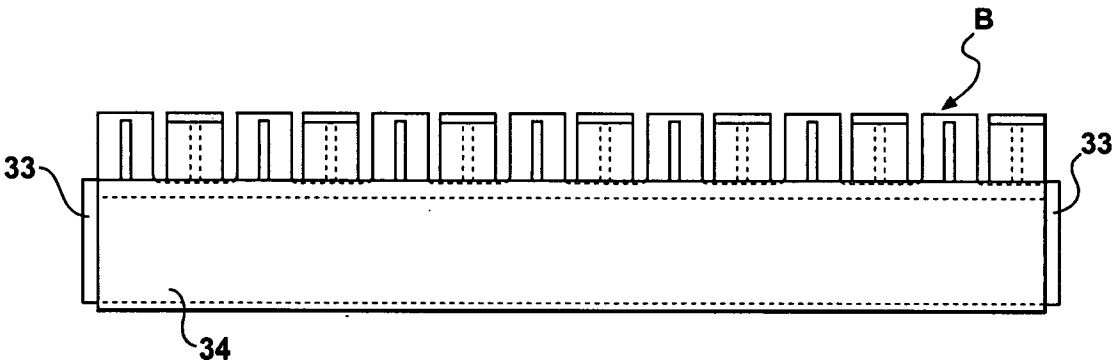
FIG. 10 is a side elevational view thereof.
Figure 9:
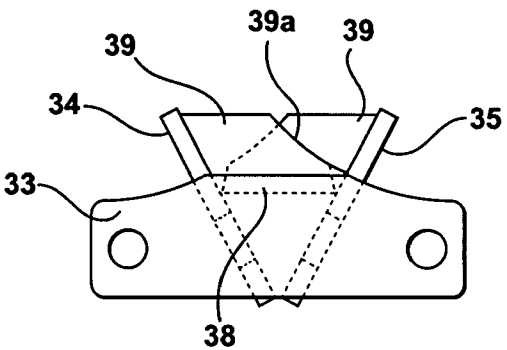
FIG. 9 is an end elevational view of the breaker bar assembly.

Beneath the rotor shaft assembly R, as shown particularly in FIG. 4, immediately adjacent to the path of the blades to be later described, is the breaker assembly B, which, as FIG. 12 discloses, comprises end plates 33, which can be supported by the walls 19 and 20 beneath the twin rotor assembly R or by other frame members to coact with the blades to be presently described. As FIGS. 9–12 illustrate, the end plates 33 support side walls 34 and 35, which converge downwardly as shown in FIG. 9, and which are configured at their upper ends to provide upstanding anvil teeth 36 separated by recesses 37. The teeth 36 have flat upper edges 36*a* and recesses 37 have flat lower edges 37*a*.

Figure 11:
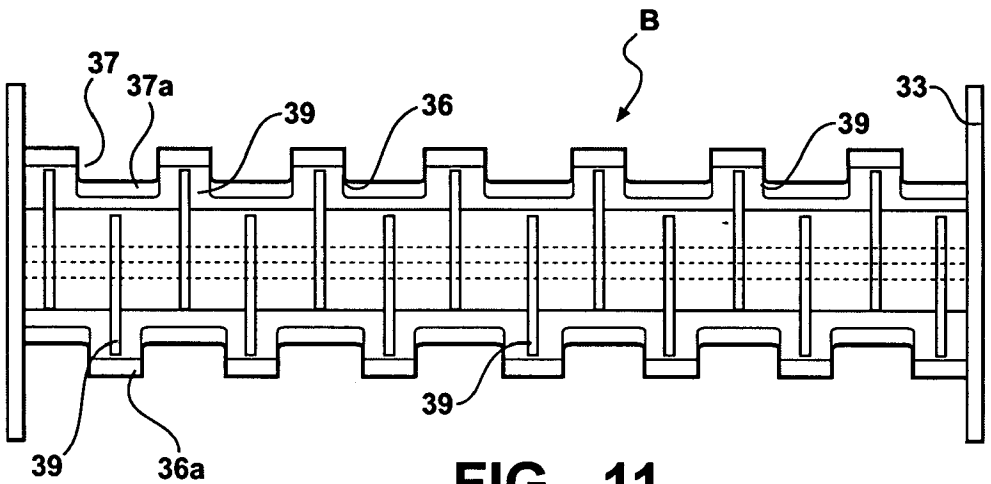
FIG. 11 is a top plan view thereof.
Figure 12:
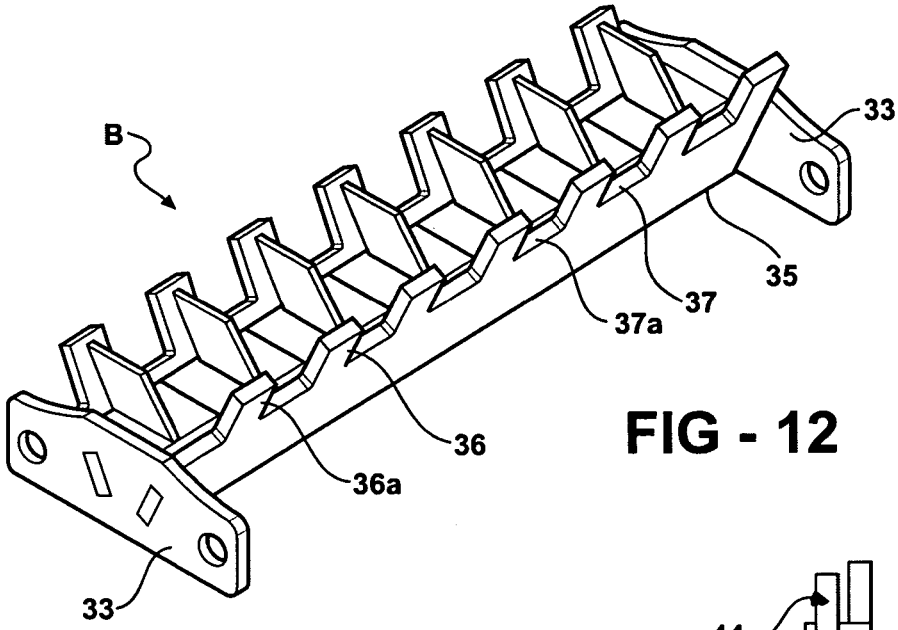
FIG. 12 is a perspective plan view of the breaker bar assembly.
Figure 14:
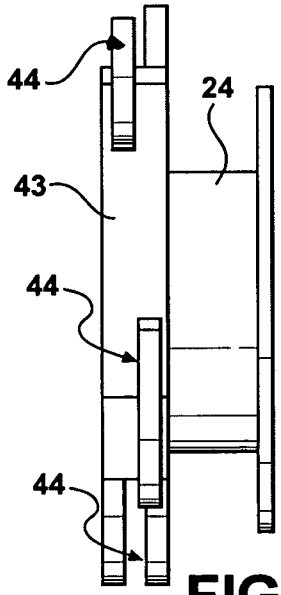
FIG. 14 is a fragmentary top plan view of one of the rotor blades.

FIG. 9 indicates that the identically configured plates 34 and 35 are bridged by a bottom wall 38, which supports gusset walls 39, spaced apart as shown in FIG. 11 to support the teeth 36 which are relatively axially staggered on the assembly B as shown in FIG. 11 on the respective walls 34 and 35. This relative staggering places a gusset plate 39 on a tooth wall 36 of plate 34 opposite a recess 37 on wall 35 over the length of the breaker assembly as shown. A gusset plate on a tooth wall 36 of plate 35 is then opposite a recess 37 on plate 34 over the length of the assembly. Both the walls 39 have downwardly curvilinear inner edges as shown at 39*a*.

Figure 13:
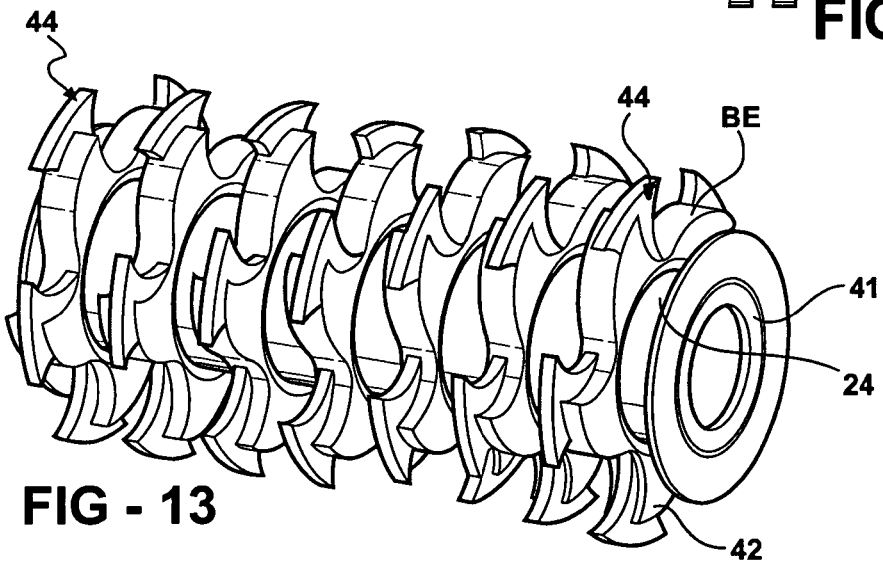
FIG. 13 is a schematic fragmentary perspective plan view of one of the identically constructed counter-rotating rotor assemblies.
Figure 16:
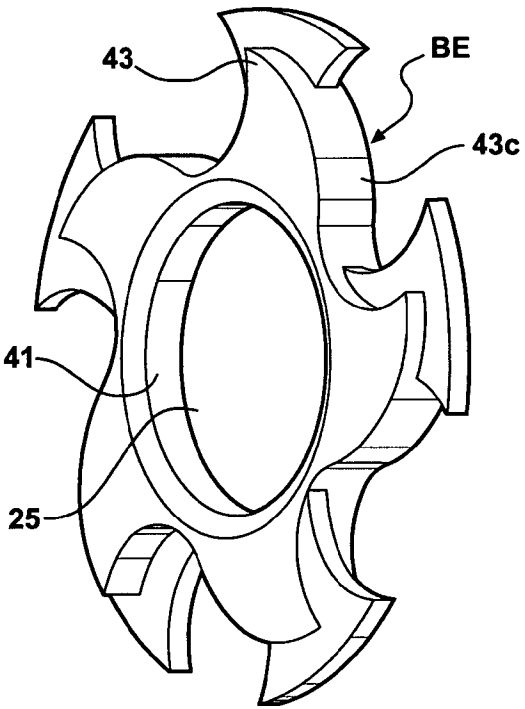
FIG. 16 is a perspective side elevational view of an identical rotor blade which is positioned to rotate in the opposite direction.
Figure 17:
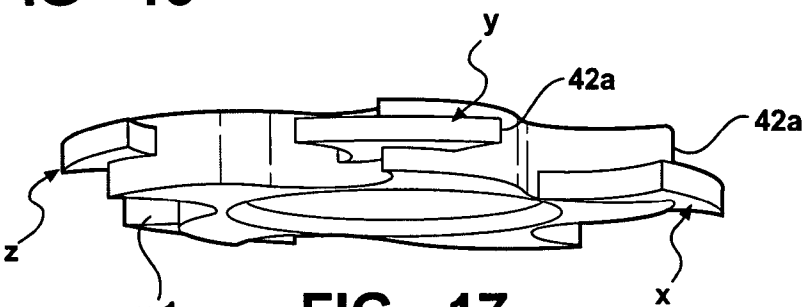
FIG. 17 is a perspective top plan view of the blade element shown in FIG. 15.
Figure 15:
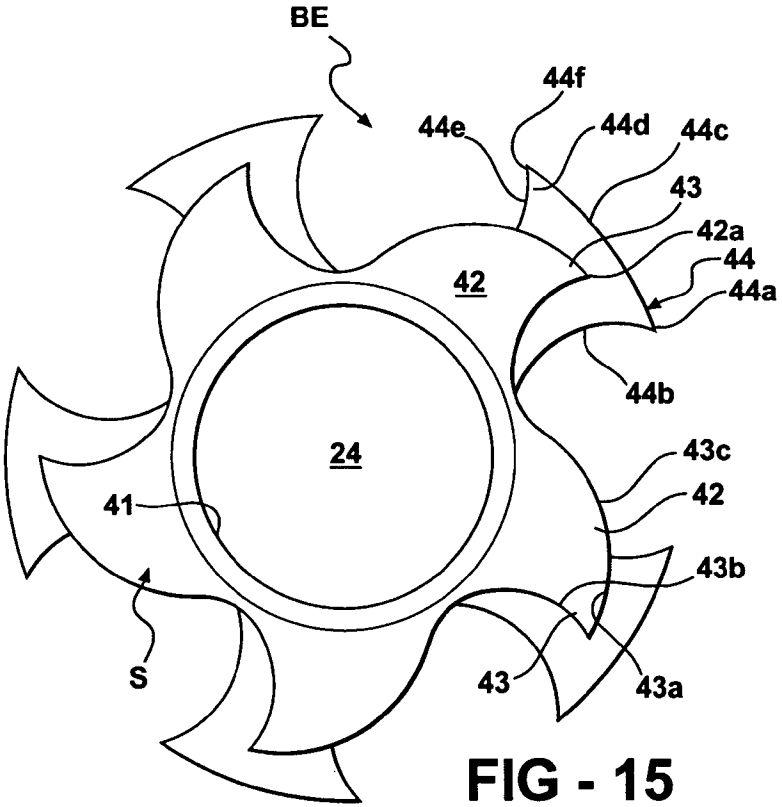
FIG. 15 is an end elevational view of one of the rotor blades on an enlarged scale.
Figure 18:
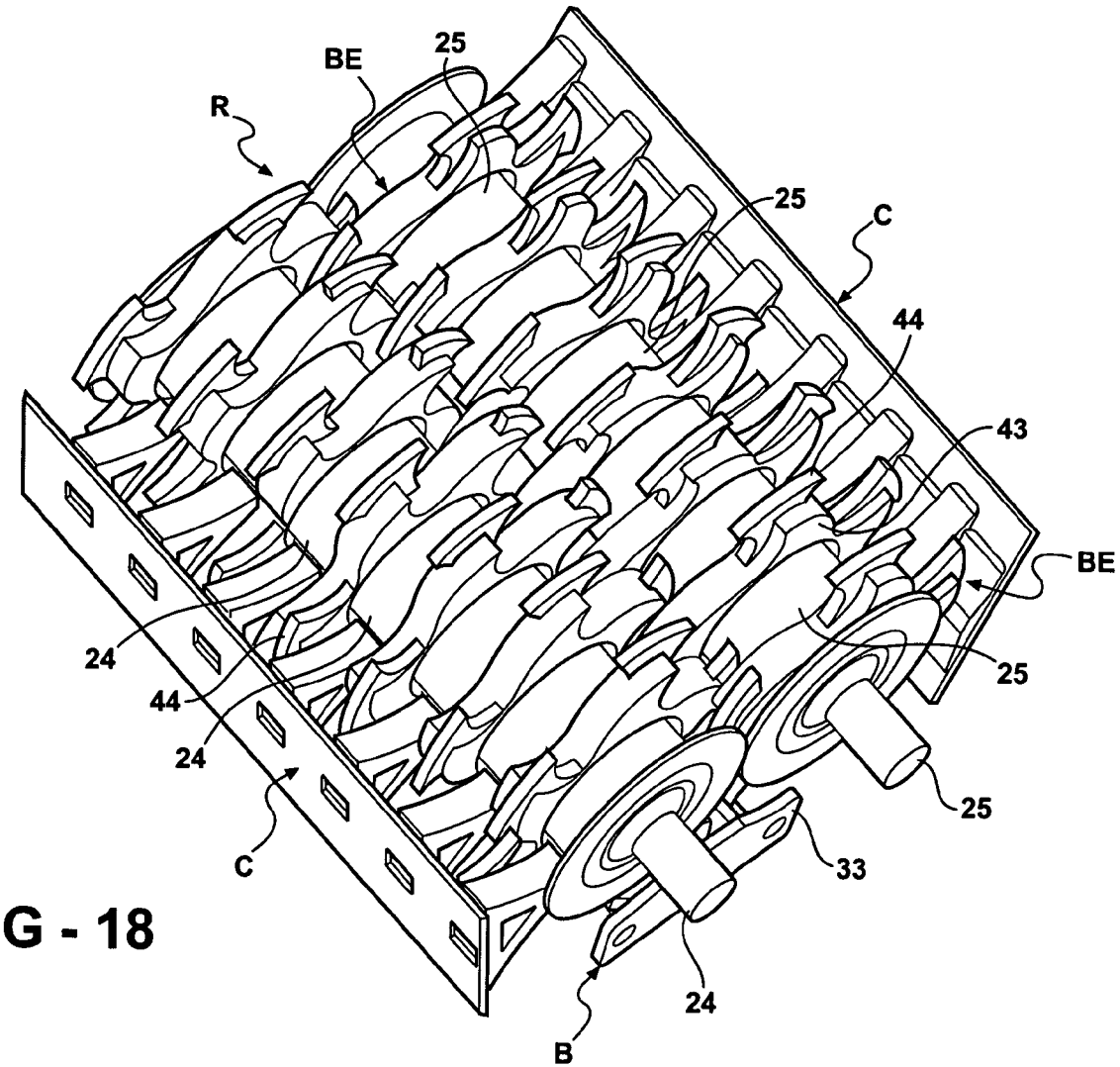
FIG. 18 is a perspective top plan view of the rotor assembly illustrating comb assembly interaction.

Shown in FIG. 13, is one of the rotors which are identical, but driven in intermeshing counter rotation. Each of the assemblies comprises a series of star-like blade structures or discs, which will now be described, fixed in axially spaced relation on each of the shafts 24 and 25. As FIG. 15 indicates, the blade elements, generally designated BE, comprise star shaped elements, generally designated S, with openings 41 for the respective shafts 24 or 25. The blades BE on the shaft 24 rotate clockwisely as shown in FIG. 15, whereas the identical blades mounted on shaft 25 in opposite disposition rotate counterclockwisely, as shown in FIGS. 16 and 17. The star shaped blades segments S are comprised of a series of curvilinear combination cutting and support bases 42, each of which comprises a leading tooth portion 43 which has a radially outer relief surface 43*a* and a more radially curvilinear relief surface 43*b*. The surface 43*a* continues curvilinearly as at 43*c* radially inwardly to provide a backing surface 43*c*.

Provided on each of the star shaped members 42 is a relatively narrower inversely L-shaped tooth member or segment, generally designated 44, and this angle-shaped tooth has a radially inner surface which conforms to and is welded on the tooth surface 43. Each tooth 44 includes a leading tooth edge surface 44*a* with a more extreme curvilinear surface 44*b* as a relief surface and an opposite more gentle relief surface 44*c*. At the trailing end of surface 44*c* is a tooth 44*d* formed by the surface 44*c* and a relief surface 44*e*. This tooth 44*d* is operable when the rotation of the blade is reversed or backed to relieve a jam or the like. Both the teeth 44 and segments S may be fashioned from a suitably hard material such as T-1 steel.

As FIGS. 16 and 17 indicate the successively mounted angle shaped teeth 44 are narrower than the segments 42 and are circumferentially laterally or axially successively staggered thereon. For example, the tooth 44 shown at "x" is positioned on one side of the segment 42 on which it is mounted and the next L-shaped tooth 44 on the circumferentially adjacent star shaped member 42 is mounted at substantially the middle of the blade BE as shown at "y". The next successive L-shaped tooth 44 is disposed on the star shaped segment 42 near its opposite side as at "z" and the next one is near the first side as at X-1; to provide a helical formation with teeth at positions "x" and "y". The staggering progression of these laterally staggered teeth 44 continues around the circumference of each blade element BE. Whereas five blade elements are illustrated, it is to be understood that several fewer or several more star shaped elements 44 may be provided. Thus, each angle shaped cutter 44 includes a leading cutting edge 44*a* and a rear cutting edge 44*f*. Since the cutting edges 44*f* will only be used when the shafts are reversed in rotation to assist in untangling material which may be impeding the grinding operation, the edges 44*f* take a much less aggressive bite better suited to clearing as opposed to grinding than do the leading cutting edges 44*a*. The cutting edges 42*a* provided on the star shaped segments 42 also take an aggressive cut, but not as aggressive a cut as do the edges 44*a*. A typical width of the narrow teeth 44 when the width of segment S is 3½ inches is 1¼ inches. Other dimensions may be utilized dependant on the material to be fragmented.

The Operation

In operation with the respective blades on shafts 24 and 25 counter rotating in meshed relation, it will be clear that the edges 44*a* in particular and also the edges 42*a* exert a considerable hooking and ripping action on the material which they engage. This ripping action is assisted by the surfaces 43*b* and 43*c* and the ripping action exerted by cutting edges 42*a* is also aggressive.

Figure 19:
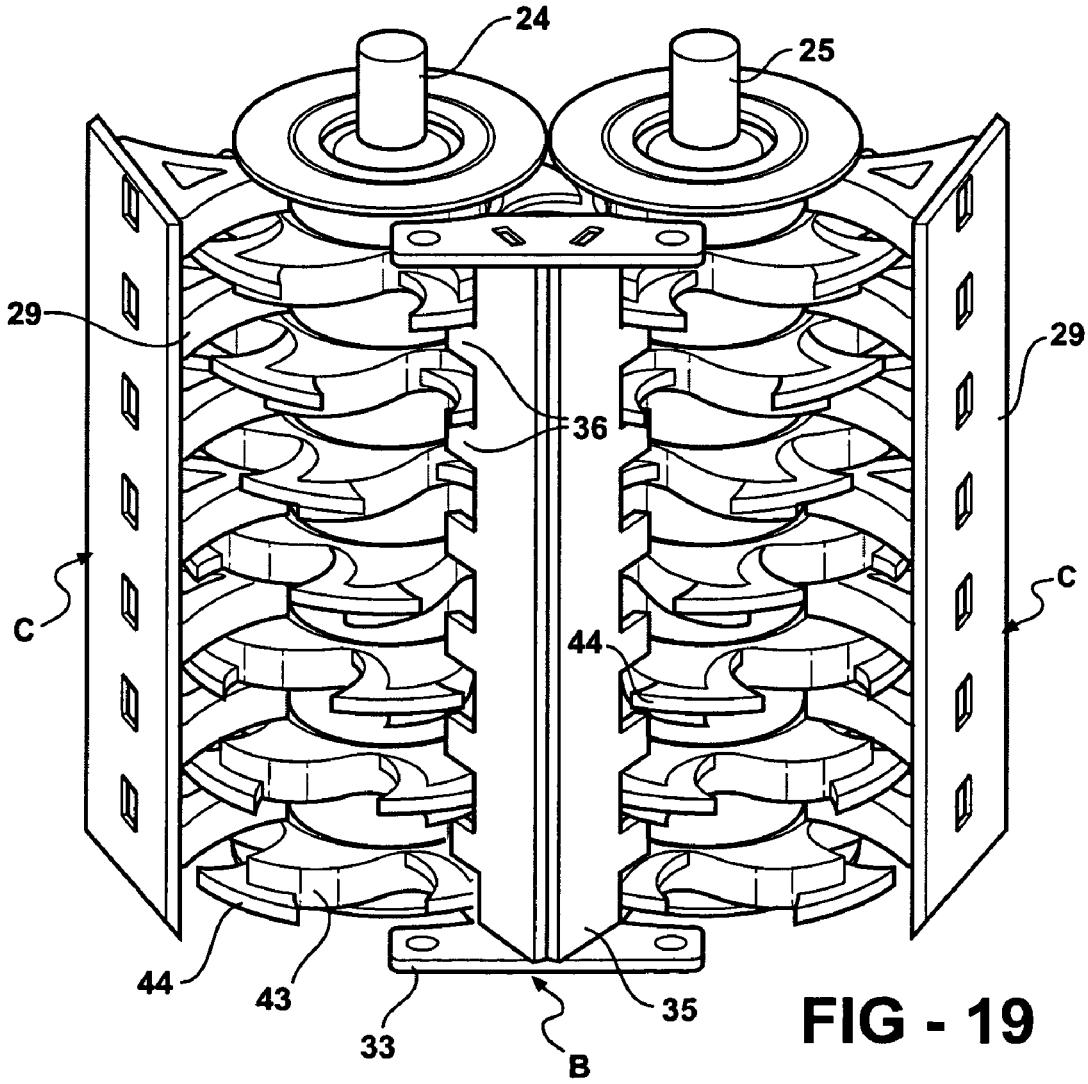
FIG. 19 is an inverse plan view of the rotor assembly further illustrating breaker bar assembly intermeshing.

The comb teeth 29, on either side of the respective blade elements BE, provides debris clearing surfaces which cooperate with the cutting teeth. As FIGS. 4 and 19 indicate, the respective shafts 24 and 25 are substantially wiped by the comb surfaces 30. The surfaces 32 wipe the surfaces 44*c* of teeth 44 and when the shafts 24 and 25 are reversed in rotation the surfaces 32 serve as anvils for the tooth edges 44*f*. The side surfaces of the comb teeth 29 also serve as anvils to break up debris.

Considering now the breaker assembly and FIG. 11, the cutting teeth of each blade element on one side of breaker assembly B passes on one side of a gusset 39 through a recessed portion 37*a* on that side of breaker assembly B and each counter rotating blade passes through a recessed portion 37*a* on the opposite side of breaker assembly B. The piercing leading edge surfaces 44*a* utilize the surfaces 37*a* as anvils and the function of the piercing teeth 42*a* is to also function with the surfaces 37*a*, but not as directly. Material ground or fragmented during this cutting action is discharged to opposite sides of the breaker assembly B to opposite of plates 34 and 35 where it drops to a suitable conveyor (not shown), or in some instances may drop to the ground. As FIG. 4 shows, the opposite shaft 24 or 25 also cooperates as an anvil at "d" for the tooth edges 44*a* and the surfaces 44*c* tend to crush material against the opposing shaft.

Typically, the shafts of the machine need run only at a speed less than 40 rpm but may run at higher speeds. Because of the star shape of the segments 42, the L-shaped teeth 44 are well able to withstand extreme compressive forces because they are backed by the segments 42. Because of the staggering of the teeth 44 at various locations "x", "y" and "z", ripping bites of the teeth are accomplished to achieve a rapid disintegration of the wood or other waste material being fed to the machine. The opposite shaft tends to act as an anvil for the leading edges 42*a* of the segments 42 in assisting shearing material which would otherwise tend to wrap around the shaft. The conforming shape of the angle shaped teeth and the teeth 43 provides a solid backup surface for the more aggressively cutting teeth 44.

It is understood that the disclosed embodiment is representative of a presently preferred form of the invention and that others that accomplish the same function are incorporated herein within the scope of the patent claims.

I claim:

1. Disintegrating apparatus for waste wood and other fragmentable material, comprising:

a. a material receiving housing open at one end for receiving material to be fragmented and at another end for the discharge of fragmented material, and having opposing side walls;

b. a rotor assembly comprising parallel shafts with an array of axially spaced cutter elements on each disposed in axially intermeshing relation with cutter elements on the other;

c. mechanism for driving said shafts in counter-rotation;

d. said cutter elements comprising radially projecting, circumferentially spaced teeth with rotatively leading first cutting edges thereon configured to take an aggressive bite of said material; and e. cutter teeth segments carried on said teeth to project generally radially therefrom and having second cutting edges thereon radially outwardly of said first cutting edges configured to take an initial axially narrower bite of said material.

2. The apparatus of claim 1 wherein said cutter segments have hook shaped leading faces disposing said second cutting edges forwardly rotatively of said first cutting edges.

3. The apparatus of claim 2 wherein said cutter segments have third cutting edges mounted on rotatively trailing faces to face in a trailing direction and assist removal of any jamming material when said counter-rotating shafts are driven in reverse direction.

4. The apparatus of claim 2 wherein said cutter segments are mounted in axially staggered relation on said cutter elements.

5. The apparatus of claim 2 wherein said cutter segments are helically disposed on said cutter elements.

6. The apparatus of claim 2 wherein said cutter elements have leading faces and radially outer faces merging to said first cutting edges and said cutter segments are L-shaped to conform to the configuration of the leading faces of said cutter elements and radially outer faces of said cutter elements.

7. The apparatus of claim 2 wherein said cutter elements are hook-like in shape with undercut leading relief faces.

8. The apparatus of claim 1 wherein a vehicle frame supports said housing which has an open top, a wood bin is mounted adjacent thereto to pivot upwardly and supply wood to said open top, and a vehicle wheel mechanism is pivotally mounted to move from a retracted position to a position in which it supports said vehicle frame for travel.

9. The apparatus of claim 1 in which comb members are mounted on said opposing side walls of said housing and incorporate comb teeth axially spaced apart to receive said cutter elements and segments in intermeshed relationship, said comb members having anvil surfaces in position to coact with said first and second teeth.

10. The apparatus of claim 9 wherein said comb teeth are generally triangularly shaped with curvilinear sides leading to a frustrum which wipes the adjacent shaft, and anvil surfaces for wiping said second edges and coacting with said first edges and provided between said comb teeth.

11. The apparatus of claim 1 wherein a breaker assembly is mounted adjacent said rotor assembly and comprises a pair of divergent plates extending toward said rotor assembly, each plate being formed with axially spaced anvil recesses to wipe said second edges and coact with said first edges.

12. A cutter disc for the drive shafts of rotor assemblies on wood fragmenting machines, comprising:

a. a shaft receiving annular base having cutter elements radially projecting in star-like array with hook projections thereon, providing first cutting edges terminating forwardly in a rotatively leading direction, and b. cutter segments mounted on said cutter elements to extend radially beyond said first cutting edges and providing second ripping cutting edges terminating forwardly in a rotatively leading direction circumferentially beyond said first cutting edges.

13. A cutter disc for the drive shafts of rotor assemblies on wood fragmenting machines, comprising:

a. a shaft receiving annular base having cutter elements radially projecting in star-like array with hook projections thereon, providing first cutting edges extending axially;

b. cutter segments mounted on said cutter elements to extend radially beyond said first cutting edges and providing second ripping cutting edges of lesser axial extent than said first edges; and c. wherein said cutter elements have peripheral relief surfaces terminating forwardly in a rotatively leading direction in said first cutting edges which merge with undercut concave surfaces forming a leading face portion rotatively, and said segments mount on said elements to project radially therefrom outwardly.

14. The cutter disc of claim 13 wherein said segments are provided in axially staggered helical formation circumferentially on said cutter elements.

15. The cutter disc of claim 14 in which said segments are L-shaped and adhere to said peripheral and facing surfaces of each cutter element.

16. The cutter disc of claim 13 wherein said segments are configured to provide third cutting edges facing in a trailing direction rotatively.

17. The cutter disc of claim 12 wherein said cutter elements have leading face portions rotatively and peripheral relief surfaces, said cutter segments abut said face portions and said relief surfaces of each cutter element.

18. The cutter disc of claim 12 wherein said cutter elements have a leading face portion rotatively, said cutter segments mount at least partially on said leading face portion.

* * * * *